United States Patent [19]

Lopez, Jr.

[11] Patent Number: 4,891,852

[45] Date of Patent: Jan. 9, 1990

[54] BASSINET ROCKER

[76] Inventor: Clisthenes F. Lopez, Jr., 22503 Meyler St., #27, Torrance, Calif. 90502

[21] Appl. No.: 312,453

[22] Filed: Feb. 21, 1989

[51] Int. Cl.[4] ..... A47D 9/04

[52] U.S. Cl. ..... 5/105; 5/107

[58] Field of Search ..... 5/101, 105–109; 297/133, 258, 272; 280/31, 47.12

[56] References Cited

U.S. PATENT DOCUMENTS

| | | | |
|---|---|---|---|
| 246,729 | 9/1881 | Darne | 5/105 |
| 524,151 | 8/1894 | Walker . | |
| 1,069,196 | 8/1913 | Smith . | |
| 1,762,680 | 6/1930 | Debelack | 280/31 |
| 2,293,560 | 8/1942 | Price | 280/31 |
| 2,688,997 | 9/1954 | Miller | 5/105 X |
| 3,158,877 | 12/1964 | Cooper . | |

FOREIGN PATENT DOCUMENTS

| | | | |
|---|---|---|---|
| 33328 | 5/1924 | Denmark | 5/107 |
| 777134 | 11/1934 | France | 5/106 |

*Primary Examiner*—Michael F. Trettel
*Attorney, Agent, or Firm*—Thomas I. Rozsa

[57] ABSTRACT

A structure which can be removably placed under the bed portion of a conventional bassinet and between its four legs such that the legs are lifted up off the gound by a sufficient distance to enable the bassinet to be rocked in either the head to toe rocking mode or cradle rocked, depending upon the orientation of the bassinet relative to the rocker sections of the present invention. A structure having at least one pair of parallel and separated rockers adjacent its lowermost portion is sized to fit beneath the bed and spaced to fit between the four legs of a conventional bassinet and oriented such that the pair of parallel and separated rockers are aligned in the same direction as the head and foot of the bassinet carriage, and the height of the structure is sized to cause the four legs of the bassinet to be lifted off the ground by a sufficient amount to permit the rockers to freely rock back and forth. In this configuration, the apparatus can be utilized with conventional modern day bassinets including those with cloth and frills on the exterior of the bassinet basket to convert the bassinet into a head to toe rocker. When the pair of parallel and separated rockers are aligned at an angle to and preferably generally perpendicular to the head and foot of the bassinet carriage, and the height of the structure is sized to cause the four legs of the bassinet to be lifted off the ground by a sufficient amount to permit the rockers to freely rock back and forth, then the apparatus can be utilized with conventional modern day bassinets including those with cloth and frills on the exterior of the bassinet basket to convert the bassinet into a cradle rocker.

12 Claims, 2 Drawing Sheets

Fig. 1.
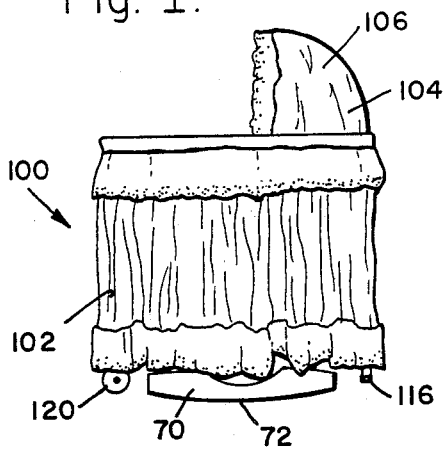
Fig. 2.
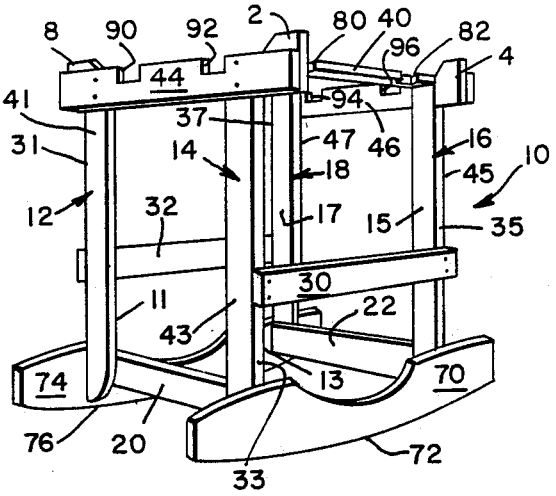
Fig. 3.
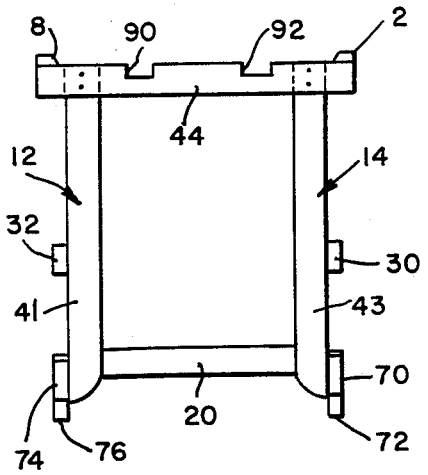
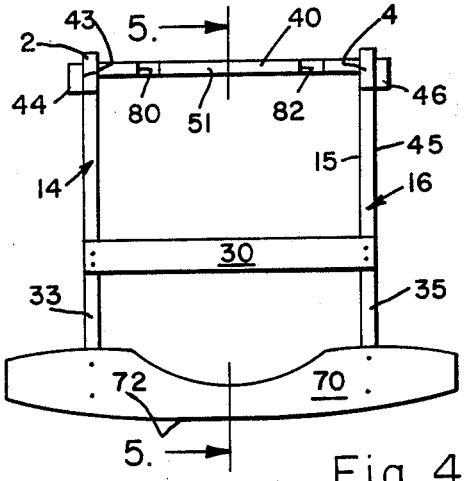
Fig. 4.
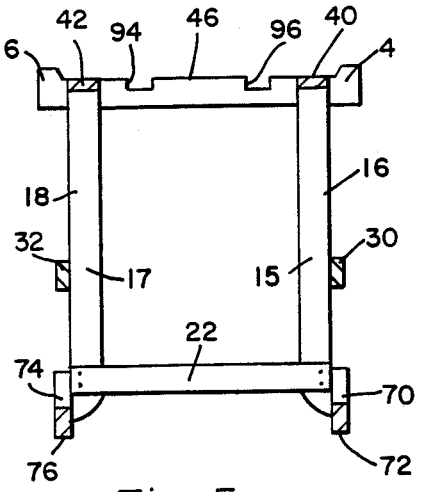
Fig. 5.
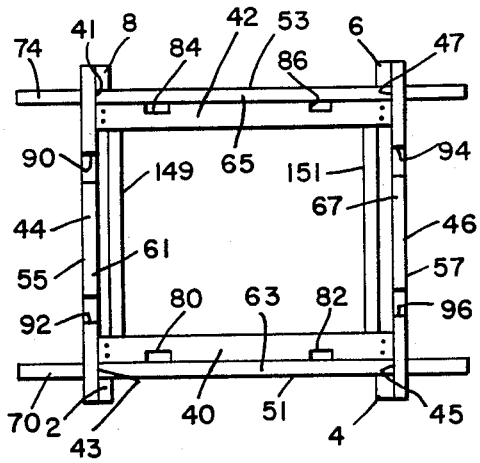
Fig. 6.

BASSINET ROCKER

BACKGROUND OF THE INVENTION

1. Field of the Invention

The present invention relates to the field of apparatus to be used in conjunction with a baby's bassinet in order to convert the bassinet from a stationary object which can only be rolled from one place to another into a rocking apparatus which can be used to assist in rocking the baby to sleep while the baby is in the bassinet. The present invention further relates to the field of rocking apparatus which can be used to convert a stationary object into one which can be rocked from either head to toe or side to side.

2. Description of the Prior Art

In general, apparatus which can be used to convert a stationary object such as a baby carriage into a rocking object have been known in the prior art. The following six patents are illustrative of the known prior art in this field:

A. U.S. Pat. No. 3,158,877 issued to Cooper on Dec. 1, 1964 for "Supporting Rocker Frame".

B. U.S. Pat. No. 1,135,266 issued to Desper on Apr. 13, 1915 for "Attachment For Perambulators".

C. U.S. Pat. No. 1,069,196 issued to Smith on Aug. 5, 1913 for "Device For Rocking Children's Cradles".

D. Danish Pat. No. 33,328 issued to Jensen in 1924.

E. U.S. Pat. No. 524,151 issued to Walker on Aug. 7, 1894 for "Rocker Attachment for Baby Carriages".

F. French Pat. No. 777,134 issued to Flandrin in 1934.

French Pat. No. 777,134 to Flandren illustrates a child's carriage which possesses an attachment transforming it into a rocker as depicted in FIG. 4. It appears that the device contains an apparatus by which the carriage can be rolled, but at the same time the wheels are capable of being rotated up off the ground so that the rocking mechanism number 4 as illustrated in FIGS. 3 and 4 is able to rock the carriage. This device is in essence only a baby carriage with a mechanism by which the wheels can be rotated above the ground so that a secondary rocking structure can touch the ground and be used to rock the baby carriage.

Danish Pat. No. 33,328 illustrates a cradle support for a child's cart body. It appears that the mechanism is a large rocking frame into which the child's cart body is placed. The cart body is supported within the rocking frame by the upper edges of the cart body such that the lower portion on which the baby rests is suspended in the air. This appears to be a cumbersome device and one which can only accommodate what is essentially a large basket without wheels.

U.S. Pat. No. 524,151 to Walker discloses a rocker attachment which is capable of converting a baby carriage into a rocker. Essentially the idea is to have the wheels of the baby carriage fall into the four slots designated as B (see FIG. 3) and thereafter be locked in placed. In this way, the baby carriage can be converted into a rocker. With a shallow frame and small rocker compared to the baby carriage, it appears that this device is extremely unstable and the baby carriage could easily tip over.

U.S. Pat. No. 1,069,196 to Smith discloses a complex apparatus wherein a child's crib can be mounted on a rocking apparatus through a spring attachment. The height of the rocker off the ground and the springs appear to make this device extremely unstable.

U.S. Pat. No. 3,158,877 to Cooper discloses a supporting rocker frame. The apparatus discloses a frame for receiving a removable basket like bed portion of a baby carriage. While this device might be operable with a simple bassinet, one problem is that the bassinet fits well within the rocking apparatus such that the bassinet is adjacent the ground and the sidewalls rest well within the frame. Today's flowery bassinets have extensive cloth with frills surrounding the bassinet and such a device could not fit well within the rocking apparatus disclosed in the Cooper patent. In addition, today's modern bassinets are elevated above the ground and are attached to a base which further comprises folding wheels. Such a device could not fit within the frame of the Cooper patent.

Therefore, while the general concept of a device for converting a baby carriage or a bassinet into a rocker has been discovered in the prior art, none of the prior art devices are functional with a modern bassinet which comprises a basket set on a base and having elongated folding legs and further comprises a fancy cloth covering and head covering with many frills. A significant need exists for such an apparatus which is capable of converting a modern baby's bassinet into a rocker.

SUMMARY OF THE PRESENT INVENTION

A bassinet is a baby's bed which often has a hood over one end. Modern day bassinets are often covered with cloth and frilly lace. The bassinet is typically mounted on a rigid structure which may contain four wheels or contain two stationary legs and two legs which have wheels at their bottom. One of the major problems with a bassinet mounted on the conventional stand having either four legs with wheels or two stationary legs and two legs with wheels is that it is extremely difficult to effectively and easily rock the bassinet. With modern day bassinets, rocking the baby in the bassinet is a major chore on the part of the mother because of the rigidity of the surface structure. The present invention is a structure which can be removably placed under the bed portion of a conventional bassinet and between its four legs such that the legs are lifted up off the ground by a sufficient distance to enable the bassinet to be rocked in either the head to toe rocking mode or cradle rocked, depending upon the orientation of the bassinet relative to the rocker sections of the present invention.

It has been discovered, according to the present invention, that if a structure having at least one pair of parallel and separated rockers adjacent its lowermost portion is sized to fit beneath the bed and spaced to fit between the four legs of a conventional bassinet and oriented such that the pair of parallel and separated rockers are aligned in the same direction as the head and foot of the bassinet carriage, and the height of the structure is sized to cause the four legs of the bassinet to be lifted off the ground by a sufficient amount to permit the rockers to freely rock back and forth, then the present invention structure can be utilized with conventional modern day bassinets including those with cloth and frills on the exterior of the bassinet basket to convert the bassinet into a head to toe rocker.

It has further been discovered, according to the present invention, that if a structure having at least one pair of parallel and separated rockers adjacent its lowermost portion is sized to fit beneath the bed and spaced to fit between the four legs of a conventional bassinet and oriented such that the pair of parallel and separated rockers are aligned at an angle to and preferably generally perpendicular to the head and foot of the bassinet carriage, and the height of the structure is sized to cause the four legs of the bassinet to be lifted off the ground by a sufficient amount to permit the rockers to freely rock back and forth, then the present invention structure can be utilized with conventional modern day bassinets including those with cloth and frills on the exterior of the bassinet basket to convert the bassinet into a cradle rocker.

It is therefore an object of the present invention to provide a rocking apparatus which can be removably placed under the bed portion of a conventional bassinet and sized so as to fit between the four legs of a conventional bassinet and sufficiently tall to enable the legs of the bassinet to be elevated above the ground and to further comprise a rocking apparatus adjacent its lowermost portion and aligned parallel to the head and foot position of the bassinet basket to thereby convert the bassinet into a head to toe rocker.

It is a further an object of the present invention to provide a rocking apparatus which can be removably placed under the bed portion of a conventional bassinet and sized so as to fit between the four legs of a conventional bassinet and sufficiently tall to enable the legs of the bassinet to be elevated above the ground and to further comprise a rocking apparatus adjacent its lowermost portion and aligned at an angle to the head and foot portion of the bassinet basket to thereby convert the bassinet into a cradle rocker.

It is another object of the present invention to provide a bassinet rocker for converting any conventional bassinet into a rocker which can be used as both a head to toe rocker and a cradle rocker, whether the bassinet be the popular models sold at JC Penny R or Sears R or other less well known models.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG.1 is a side elevational view of a conventional bassinet including cloth covering and frilly lace extending from the sides of the bassinet bed and over the hood covering the baby's head, with the bassinet mounted on the present invention bassinet rocker.

FIG. 2 is a perspective view of the present invention bassinet rocker.

FIG. 3 is a front elevational view of the present invention bassinet rocker.

FIG. 4 is a side elevational view of the present invention bassinet rocker.

FIG. 5 is a cross-sectional view taken along line 5—5 of FIG. 4.

FIG. 6 is a top plan view of the present invention bassinet rocker.

DETAILED DESCRIPTION OF THE PREFERRED EMBODIMENT

Figure 7:
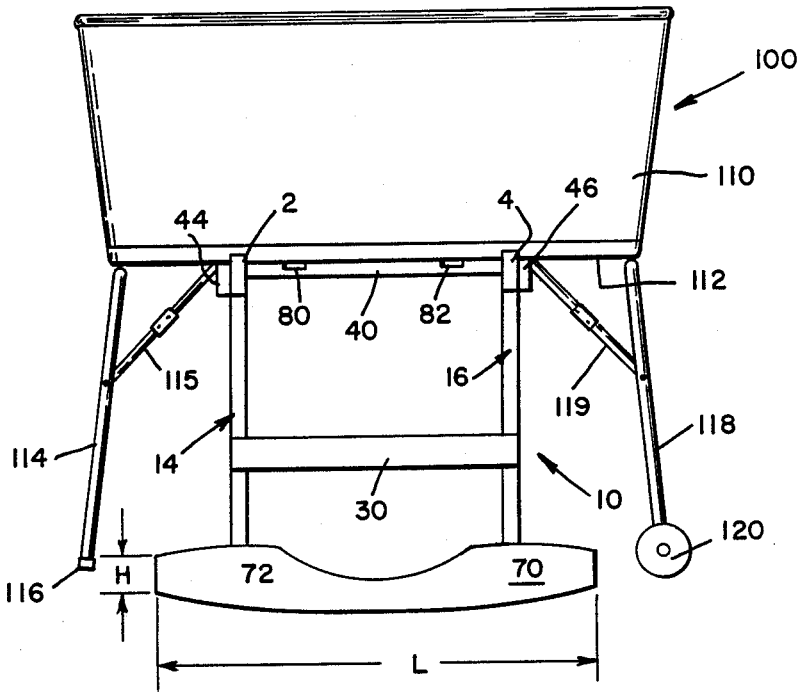
FIG. 7 is a side elevational view of the present invention bassinet rocker supporting a bassinet with the cloth and frill covering removed to illustrate the method by which the legs of the bassinet are elevated above the ground and the bassinet is converted into a head to toe rocker.

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 2, there is shown at 10 the present invention bassinet rocker. The bassinet rocker 10 is a rocking structure comprised of four vertical posts 12, 14, 16 and 18 which are held together by several cross beams. First lower widthwise cross beam 20 joins vertical posts 12 and 14 together in the widthwise direction. As shown in FIG. 2, in the preferred embodiment, first lower widthwise cross beam 20 is located on the interior facing widthwise surfaces 11 and 13 of vertical posts 12 and 14 respectively. It is also within the spirit and scope of the present invention to have first lower widthwise cross beam 20 connecting the two vertical posts 12 and 14 on their exterior facing surfacing. Second lower widthwise cross beam 22 joins vertical posts 16 and 18 together in the widthwise direction As shown in FIG. 2, in the preferred embodiment, second lower widthwise cross beam 22 is located on the interior facing widthwise surfaces 15 and 17 of vertical posts 16 and 18 respectively. It is also within the spirit and scope of the present invention to have second lower widthwise cross beam 22 connecting the two vertical posts 16 and 18 on their exterior facing surfacing. First middle lengthwise cross beam 30 joins vertical posts 14 and 16 in the lengthwise direction. As shown in FIG. 2, in the preferred embodiment, first middle lengthwise cross beam 30 is located on the exterior facing lengthwise surfaces 33 and 35 of vertical posts 14 and 16 respectively. It is also within the spirit and scope of the present invention to have first middle lengthwise cross beam 30 connecting the two vertical posts 14 and 16 on their interior facing surfaces. Second middle lengthwise cross beam 32 joins vertical posts 18 and 12 in the lengthwise direction. As shown in FIG. 2, in the preferred embodiment, second middle lengthwise cross beam 32 is located on the exterior facing lengthwise surfaces 37 and 31 of vertical posts 18 and 12 respectively. It is also within the spirit and scope of the present invention to have second middle lengthwise cross beam 32 connecting the two vertical posts 18 and 12 on their interior facing surfaces.

The four posts 12, 14, 16 and 18 are also joined together at their tops by four cross beams which also serve as the base on which the bassinet is mounted. First upper lengthwise cross beam 40 joins vertical posts 14 and 16 in the lengthwise direction and is joined to the posts at their respective tops. Second upper lengthwise cross beam 42 joins vertical posts 18 and 12 in the lengthwise direction and is joined to the posts at their respective tops. First upper widthwise cross beam 44 joins vertical posts 12 and 14 in the widthwise direction and is joined to the posts along their respective widthwise facing exterior surfaces 41 and 43 respectively. As illustrated in FIG. 6, the ends of the two upper lengthwise cross beams 40 and 42 are flush with the exterior surfaces 41 and 43 of vertical posts 12 and 14 and the top surfaces of 63 and 65 of first upper lengthwise cross beam 40 and second upper lengthwise cross beam 42 respectively are even with the top surface 61 of first upper widthwise cross beam 44. Second upper widthwise cross beam 46 joins vertical posts 16 and 18 in the widthwise direction and is joined to the posts along their respective widthwise facing exterior surfaces 45 and 47 respectively. As illustrated in FIG. 6, the ends of the two upper lengthwise cross beams 40 and 42 are flush with the exterior surfaces 45 and 47 of vertical posts 16 and 18 and the top surfaces of 63 and 65 of first upper lengthwise cross beam 40 and second upper lengthwise cross beam 42 respectively are even with the top surface 67 of second upper widthwise cross beam 46. Therefore, the respective top surfaces 61, 63, 65 and 67 are all in the same plane and form a surface onto which can be placed the baby basket or bed portion of the bassinet.

Supported on vertical posts 14 and 6 and attached to their outward lengthwise faces 33 and 35 respectively adjacent the bottom of vertical posts 14 and 16 is a first rocking member 70 comprising an arcuate lower surface 72. Supported on vertical posts 18 and 12 and attached to their outward lengthwise faces 37 and 31 respectively adjacent the bottom of vertical posts 18 and 12 is a second rocking member 74 comprising an arcuate lower surface 76. First rocking member 70 and second rocking member 74 are aligned generally parallel to each other such that their respective lower arcuate surfaces 72 and 76 are in the same plane and along which the bassinet rocker 10 can be rocked back and forth. Both rocking members 72 and 76 extend along the lengthwise direction of the bassinet rocker 10.

First upper lengthwise cross beam 40 further comprises a pair of spaced apart notches 80 and 82 which extend out of its outwardly facing lengthwise face 51. Second upper lengthwise cross beam 42 further comprises a pair of spaced apart notches 84 and 86 which extend out of its outwardly facing lengthwise face 53. Notch 80 is generally parallel to and aligned with notch 84. Notch 82 is generally parallel to and aligned with notch 86. While each notch extends out of the outward face of the respective cross beam and only extends partially into the cross beam, it is also within the spirit and scope of the present invention for each notch to be a slot extending through the width of each cross beam.

First upper widthwise cross beam 44 further comprises a pair of spaced apart notches 90 and 92 which extend out of its outwardly facing widthwise face 55. Second upper widthwise cross beam 46 further comprises a pair of spaced apart notches 94 and 96 which extend out of its outwardly facing widthwise face 57. Notch 90 is generally parallel to and aligned with notch 94. Notch 92 is generally parallel to and aligned with notch 96. While each notch extends out of the outward face of the respective cross beam and extends through the entire cross beam, it is also within the spirit and scope of the present invention for each notch to only extend partially into its respective cross beam.

A bassinet 100 is shown mounted on the bassinet rocker 10 in the lengthwise or head to toe direction in FIG. 1. The exterior of the bassinet 100 usually comprises a cloth skirt 102 and a hood portion 104 which is also covered with frilly lace 106. For purposes of illustrating the way the bassinet 100 can be mounted on the present invention bassinet rocker 10, the cloth skirt 102 and the hood portion 104 and frilly lace 106 thereon have been removed from the bassinet in the illustrations of FIGS. 7 and 8. Referring first to FIG. 7, the bassinet 100 comprises a bed or basekt portion 110 further comprising a flat bottom 112. The bassinet 100 also comprises 4 legs which are generally located at the four corners of the bassinet, two of which 114 and 118 are illustrated in FIG. 7. Leg 114 has a stationary bottom 116. A parallel stationary leg (not shown) is located at the remote left corner of the bassinet 100. Leg 118 has a wheel 120 at its bottom. A parallel leg with a wheel (not shown) is located at the remote right corner of the bassinet 100. In some bassinets all four legs have wheels at the bottom. In the head to toe rocking position as illustrated in FIG. 7, the bassinet 100 is placed onto the bassinet rocker 10 such that the flat bottom 112 rests and all four cross beams, with the length of the bassinet bottom 112 resting along the length of the top 63 of first lengthwise cross beam 40 and resting along the length of the top 65 of second lengthwise cross beam 42. A portion of the width of bassinet bottom 112 rests along the length of the top 61 of first widthwise cross beam 44 and along the length of the top 67 of second widthwise cross beam 46. The legs of the bassinet 100 can usually be folded up against the bottom of the bassinet 100 by a folding metal brace. There is one folding metal brace for each leg. In the illustration in FIG. 7, first leg 114 is folded up by folding metal brace 115 and second leg 118 is folded up by folding metal brace 119. The upper end of folding metal brace 115 rests against notch 92 and the upper end of folding metal brace 119 rests against notch 96. It will be appreciated that the two legs not shown also have folding metal braces which rest against notches 90 and 94 respectively. At the four corners of the bassinet rocket 10 are four stop, 2, 4, 6 and 8 respectively. The stops are supported on the face of the two widthwise cross beams. In the Figures, the four stops are shown on the inward face of the widthwise cross beams. Stops 8 and 2 are mounted on inner face 149 of first widthwise cross beam 44. Stop 8 abuts the outward lengthwise face 53 of second lengthwise cross beam 42. Stop 2 abuts the outward lengthwise face 51 of first lengthwise cross beam 40. Stops 4 and 6 are mounted on inner face 151 of second widthwise cross beam 46. Stop 6 abuts the outward lengthwise face 53 of second lengthwise cross beam 42. Stop 4 abuts the outward lengthwise face 51 of first lengthwise cross beam 40. In an alternative embodiment, the four stops can be mounted on the outwardly facing lengthwise face of the two widthwise cross beams and therefore do not abut a lengthwise cross beam. The location of the stops will depend upon the width of the bassinet 100. This modification is designed to accommodate all sizes of modern day bassinets. In the embodiment illustrated in FIG. 7, the bassinet bed 110 is supported in the widthwise direction between the four stops 2, 4, 6 and 8 so that it cannot slide off the bassinet rocker 10 in the widthwise direction. The four braces set within the respective notches on the widthwise cross beams, as previously described, prevents the bassinet 100 from sliding off the bassinet rocker 10 in the lengthwise direction.

A critical feature of the present invention is that the combined vertical height of each of the four vertical posts 12, 14 , 16 and 18 and the extra height added by the rocker members 70 and 72 is greater than the vertical height of the legs (114, 118 and the two not shown) such that the legs are elevated off the ground when the bassinet 100 is placed on the bassinet rocker 10. In this manner, the rocker members 70 and 72 can cause the bassinet rocker 10 and the bassinet 100 resting thereon to be rocked back and forth. In the illustration shown in FIG. 7, the bassinet is head to toe rocked.

Figure 8:
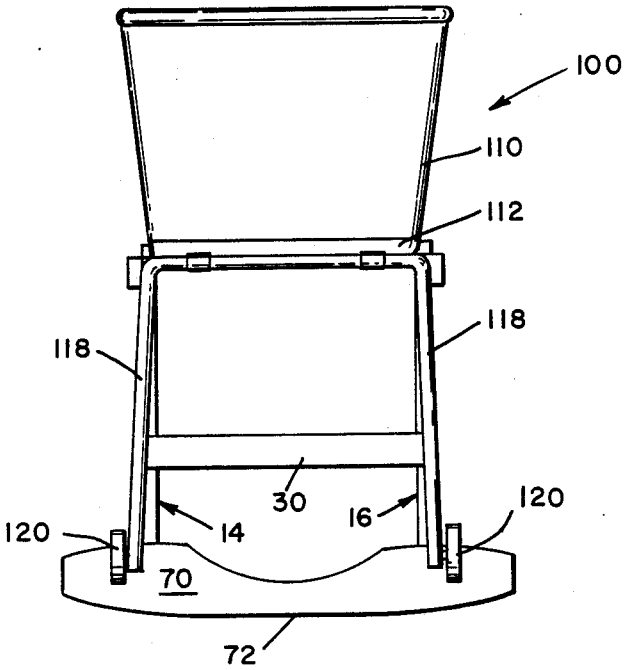
FIG. 8 is a side elevational view of the present invention bassinet rocker supporting a bassinet illustrated in a front elevational view with the cloth and frill covering removed to illustrate the method by which the legs of the bassinet are elevated above the ground and the bassinet is converted into a cradle rocker.

The alternative positioning for the bassinet 100 is illustrated in FIG. 8. In the cradle rocking position as illustrated in FIG. 8, the bassinet 100 is placed onto the bassinet rocker 10 such that the flat bottom 112 rests and all four cross beams, with the length of the bassinet bottom 112 resting along the length of the top 61 of first widthwise cross beam 44 and resting along the length of the top 67 of second widthwise cross beam 46. A portion of the width of bassinet bottom 112 rests along the length of the top 63 of first lengthwise cross beam 40 and along the length of the top 65 of second lengthwise cross beam 42. In the illustration in FIG. 8, first leg 114 is folded up by folding metal brace 115 and second leg 118 is folded up by folding metal brace 119. The upper end of folding metal brace 115 rests against notch 82 and the upper end of folding metal brace 119 rests against notch 86. It will be appreciated that the two legs not shown also have folding metal braces which rest against notches 80 and 84 respectively. In the embodiment illustrated in FIG. 8, the bassinet bed 110 is supported in the lengthwise direction between the four stops 2, 4, 6 and 8 so that it cannot slide off the bassinet rocker 10 in the lengthwise direction. The four braces set within the respective notches on the lengthwise cross beams, as previously described, prevents the bassinet 100 from sliding off the bassinet rocker 10 in the widthwise direction.

Once again, a critical feature of the present invention is that the combined vertical height of each of the four vertical posts 12, 14 , 16 and 18 and the extra height added by the rocker members 70 and 72 is greater than the vertical height of the legs (114, 118 and the two not shown) such that the legs are elevated off the ground when the bassinet 100 is placed on the bassinet rocker 10. In this manner, the rocker members 70 and 72 can cause the bassinet rocker 10 and the bassinet 100 resting thereon to be rocked back and forth. In the illustration shown in FIG. 8, the bassinet is cradle rocked.

Described more broadly, the present invention an apparatus for holding and rocking a bassinet having a bed including a horizontally disposed bottom surface and legs supporting the bassinet bed, comprising: (a) four spaced apart vertical posts joined together by cross beams to form a vertically disposed structure; (b) four horizontal cross beams each joining a respective two vertical posts adjacent the tops of the posts to thereby form a horizontally disposed planar surface comprised of the four horizontal cross beams supported by the four vertical posts; (c) a pair of spaced apart generally parallel rocker members, each rocker member having an arcuate lower surface, and one rocker member attached adjacent the lowermost portion of two vertical posts and the other rocker member attached adjacent the lowermost portion of the remaining two vertical posts in a manner such that the lowermost arcuate portion of each rocker member lies in the same horizontal plane; and (d) the vertical distance from the lowermost point of the arcuate lower surface of a rocker member to the horizontal plane formed by the four horizontal cross beams is greater than the vertical height of the legs of the bassinet when the bassinet is placed upon the apparatus; (e) whereby the bassinet is placed upon said apparatus such that its horizontally disposed bottom surface rests on and is supported by the four horizontal cross beams such that the legs of the bassinet are raised above the ground to permit the rocker members to rock back and forth when a horizontal rocking force is imparted to the bassinet.

The apparatus for holding and rocking a bassinet in further comprises four stop members, a respective stop member located adjacent the top of a respective one of the four vertical posts, to prevent the bassinet from sliding off the apparatus when the bassinet is rocked back and forth.

The bassinet further includes a brace member attached to each leg of the bassinet to permit the leg to be folded up when the bassinet is not in use and each horizontal cross beam further comprises at least one notch to permit the uppermost end of a brace member to be accommodated within a notch to thereby provide further support for the bassinet when placed upon the four cross beams.

In one embodiment, the bassinet is mounted on said four cross beams and positioned relative to the two rocker members such that the bassinet is head to toe rocked when the apparatus is rocked back and forth.

In an alternative embodiment, the bassinet is mounted on said four cross beams and positioned relative to the two rocker members such that the bassinet is cradle rocked when the apparatus is rocked back and forth.

In the preferred embodiment, the four vertical posts, all cross beams and the pair of rocker members are made of wood.

The cross beams are attached to the vertical posts by any type of conventional fastening means such as screws, nut and bolt arrangements, nails, brads, tacks, or staples. The various dimensions of the components of the bassinet are a matter of design choice. The present invention can be sized to fit particular modern day bassinets sold by Sears R or JC Penny R or any other bassinet made by other manufacturers and sold through other retailers. By way of example only, the length L of a rocker member 70 can be approximately 22 inches which its vertical height H from the lowermost point of the arcuate lower surface 72 to its outermost tip can be approximately 3 and ½ inches. The length of each upper widthwise cross beam can be approximately 18 and ½ inches and can be approximately 1 and ½ inches in height and approximately ¾ inches thick. The length of each upper lengthwise cross beam and each middle lengthwise cross beam can be approximately 14 and ⅜ inches in length, approximately 1 and ½ inches in height and approximately ¾ inches thick. The length of each lower widthwise cross beam can be approximately 15 and ¼ inches long, approximately 1 and ½ inches in height and approximately ¾ inches thick. Each stop member can be approximately 2 and ¼ inches in maximum height by 1 and ⅝ inches in maximum width. Each vertical post can be approximately 15 and ¾ inches in length, approximately 1 and ½ inches in height and approximately ¾ inches thick. For certain large models of bassinets, the length of each vertical post can be approximately 17 inches. The other dimensions remain the same. Each notch can be approximately ¾ inch to 1 inch wide. Notches on the lengthwise cross beams can begin approximately 1 and ¾ inches from each end and notches on the widthwise cross beams can begin approximately 3 and ¾ inches from each end. It is emphasized that these are merely representative dimensions and other dimensions are certainly within the spirit and scope of the present invention.

Of course the present invention is not intended to be restricted to any particular form or arrangement, or any specific embodiment disclosed herein, or any specific use, since the same may be modified in various particular or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for holding and rocking a bassinet having a bed including a horizontally disposed bottom surface and legs supporting the bassinet bed, comprising:

a. four spaced apart vertical posts joined together by cross beams to form a vertically disposed structure;

b. four horizontal cross beams each joining a respective two vertical posts adjacent the tops of the posts to thereby form a horizontally disposed planar surface comprised of the four horizontal cross beams supported by the four vertical posts;

c. a pair of spaced apart generally parallel rocker members, each rocker member having an arcuate lower surface, and one rocker member attached adjacent the lowermost portion of two vertical posts and the other rocker member attached adjacent the lowermost portion of the remaining two vertical posts in a manner such that the lowermost arcuate portion of each rocker member lies in the same horizontal plane; and d. the vertical distance from the lowermost point of the arcuate lower surface of a rocker member to the horizontal plane formed by the four horizontal cross beams is greater than the vertical height of the legs of the bassinet when the bassinet is placed upon the apparatus;

e. whereby the bassinet is placed upon said apparatus such that its horizontally disposed bottom surface rests on and is supported by the four horizontal cross beams such that the legs of the bassinet are raised above the ground to permit the rocker members to rock back and forth when a horizontal rocking force is imparted to the bassinet.

2. The apparatus for holding and rocking a bassinet in accordance with claim 1 further comprising four stop members, a respective stop member located adjacent the top of a respective one of the four vertical posts, to prevent the bassinet from sliding off the apparatus when the bassinet is rocked back and forth.

3. The apparatus for holding and rocking a bassinet in accordance with claim 1 wherein the bassinet further includes a brace member attached to each leg of the bassinet to permit the leg to be folded up when the bassinet is not in use and each horizontal cross beam further comprises at least one notch to permit the uppermost end of a brace member to be accommodated within a notch to thereby provide further support for the bassinet when placed upon the four cross beams.

4. The apparatus for holding and rocking a bassinet in accordance with claim 1 wherein the bassinet is mounted on said four cross beams and positioned relative to the two rocker members such that the bassinet is head to toe rocked when the apparatus is rocked back and forth.

5. The apparatus for holding and rocking a bassinet in accordance with claim 1 wherein the bassinet is mounted on said four cross beams and positioned relative to the two rocker members such that that bassinet is cradle rocked when the apparatus is rocked back and forth.

6. The apparatus for holding and rocking a bassinet in accordance with claim 1 wherein the four vertical posts, all cross beams and the pair of rocker members are made of wood.

7. An apparatus for holding and rocking a bassinet having a bed including a horizontally disposed bottom surface and legs supporting the bassinet bed, comprising:

a. a first vertical post, a second vertical post, a third vertical post and a fourth vertical post, the vertical posts being spaced apart and vertically aligned relative to each other to form a rectangular structure;

b. a first lower widthwise cross beam joining said first and second vertical posts together adjacent their lowermost ends;

c. a second lower widthwise cross beam joining said third and fourth vertical posts together adjacent their lowermost ends;

d. a first middle lengthwise cross beam joining said second and third vertical posts together at a location along the length of the two vertical posts;

e. a second middle lengthwise cross beam joining said fourth and first vertical posts together at a location along the length of the two vertical posts;

f. a first upper lengthwise cross beam joining said second and third vertical posts together adjacent the tops of the vertical posts;

g. a second upper lengthwise cross beam joining said fourth and first vertical posts together adjacent the tops of the vertical posts;

h. a first upper widthwise cross beam joining said first and second vertical posts together adjacent the tops of the vertical posts;

i. a second upper widthwise cross beam joining said third and fourth vertical posts together adjacent the tops of the vertical posts;

j. the upper surfaces of said first upper widthwise cross beam, said second upper widthwise cross beam, said first upper lengthwise cross beam and said second upper lengthwise cross beam all lying in the same plane to thereby form a horizontal planar surface;

k. a first rocking member having an arcuate lower surface and attached to said second and third vertical posts adjacent the bottom ends of the posts;

l. a second rocking member having an arcuate lower surface and attached to said fourth and first vertical posts adjacent the bottom ends of the posts;

m. said first rocking member and said second rocking member aligned parallel to one another such that the lowermost portions of their respective arcuate lower surfaces lie in the same plane; and n. the vertical distance from the lowermost point of the arcuate lower surface of a rocker member to the horizontal plane formed by the first upper widthwise cross beam, the second upper widthwise cross beam, the first upper lengthwise cross beam and the second upper lengthwise cross beam is greater than the vertical height of the legs of the bassinet when the bassinet is placed upon the apparatus;

o. whereby the bassinet is placed upon said apparatus such that its horizontally disposed bottom surface rests on and is supported by the upper surface of the first upper widthwise cross beam, the upper surface of the second upper widthwise cross beam, the upper surface of the first upper lengthwise cross beam and the upper surface of the second upper lengthwise cross beam such that the legs of the bassinet are raised above the ground to permit the rocker members to rock back and forth when a horizontal rocking force is imparted to the bassinet.

8. The apparatus for holding and rocking a bassinet in accordance with claim 7 further comprising:

a. a first stop member supported by and adjacent one end of said first upper widthwise cross beam and located adjacent the top of said first vertical post;

b. a second stop member supported by and adjacent one end of said first upper widthwise cross beam and located adjacent the top of said second vertical post;

c. a third stop member supported by and adjacent one end of said second upper widthwise cross beam and located adjacent the top of said third vertical post; and d. a fourth stop member supported by and adjacent one end of said second upper widthwise cross beam and located adjacent the top of said fourth vertical post;

e. whereby the stop members serve to prevent the bassinet from sliding off the apparatus when the bassinet is rocked back and forth.

9. The apparatus for holding and rocking a bassinet in accordance with claim 7 wherein the bassinet further includes four legs located at the respective corners of the bassinet and a brace member attached to each leg of the bassinet to permit the leg to be folded up when the bassinet is not in use and the apparatus for holding and rocking the bassinet further comprises:

a. a pair of spaced apart notches in said first upper widthwise cross beam located on the upper surface of the cross beam and extending out of the outward facing face of the cross beam;

b. a pair of spaced apart notches in said second upper widthwise cross beam located on the upper surface of the cross beam and extending out of the outward facing face of the cross beam, a respective one of the notches in the second upper widthwise cross beam being aligned with a respective one of the notches in the first upper widthwise cross beam;

c. a pair of spaced apart notches in said first upper lengthwise cross beam located on the upper surface of the cross beam and extending out of the outward facing face of the cross beam; and d. a pair of spaced apart notches in said second upper lengthwise cross beam located on the upper surface of the cross beam and extending out of the outward facing face of the cross beam, a respective one of the notches in the second upper lengthwise cross beam being aligned with a respective one of the notches in the first upper lengthwise cross beam;

e. whereby when the bassinet is placed on the apparatus such that its head to toe orientation is aligned with the two upper lengthwise cross beams, a respective notch in the first and second upper widthwise cross beams can accommodate the uppermost end of a brace member to thereby provide further support for the bassinet when placed upon the four upper cross beams and when the bassinet is placed on the apparatus such that its head to toe orientation is aligned with the two upper widthwise cross beams, a respective notch in the first and second upper lengthwise cross beams can accommodate the uppermost end of a brace member to thereby provide further support for the bassinet when placed upon the four upper cross beams.

10. The apparatus for holding and rocking a bassinet in accordance with claim 7 wherein the bassinet is mounted on said four upper cross beams such that its lengthwise head to toe orientation lies along said first upper lengthwise cross beam and said second upper lengthwise cross beam and is positioned relative to the two rocker members such that the bassinet is head to toe rocked when the apparatus is rocked back and forth.

11. The apparatus for holding and rocking a bassinet in accordance with claim 7 wherein the bassinet is mounted on said four upper cross beams such that its lengthwise head to toe orientation lies along said first upper widthwise cross beam and said second upper widthwise cross beam and is positioned relative to the two rocker members such that the bassinet is cradle rocked when the apparatus is rocked back and forth.

12. The apparatus for holding and rocking a bassinet in accordance with claim 7 wherein each of the components of the apparatus is made of wood.

* * * * *